343-754

SR

8/10/82 OR 4,344,077

United States Patent [19]

Chekroun et al.

[11] 4,344,077

[45] Aug. 10, 1982

[54] ADAPTIVE SPATIAL MICROWAVE FILTER

[75] Inventors: Claude Chekroun, Bures sur Yvette; Yves C. Michel, Massy; Henri Sadones, Paris, all of France

[73] Assignee: Societe d'Etude du Radant, Orsay, France

[21] Appl. No.: 117,243

[22] Filed: Jan. 31, 1980

[30] Foreign Application Priority Data

Feb. 5, 1979 [FR] France ..... 79 02918

[51] Int. Cl.[3] ..... H01Q 17/00

[52] U.S. Cl. ..... 343/754; 343/909

[58] Field of Search ..... 343/753, 754, 755, 854, 343/909

[56] References Cited

U.S. PATENT DOCUMENTS

| | | | |
|---|---|---|---|
| 2,867,801 | 1/1959 | Mariner et al. | 343/756 |
| 2,959,783 | 11/1960 | Iams | 343/754 |
| 2,986,734 | 5/1961 | Jones et al. | 343/854 |
| 3,213,454 | 10/1965 | Ringenbach | 343/754 |
| 3,276,023 | 9/1966 | Dorne et al. | 343/754 |
| 3,354,461 | 11/1967 | Kelleher | 343/854 |
| 3,392,393 | 7/1968 | Spitz | 343/754 |
| 3,569,974 | 3/1971 | McLeod | 343/754 |
| 3,961,333 | 6/1976 | Purinton | 343/872 |
| 4,169,268 | 9/1979 | Schell et al. | 343/909 |
| 4,212,014 | 7/1980 | Chekroun | 343/754 |

FOREIGN PATENT DOCUMENTS

| | | |
|---|---|---|
| 2321044 | 11/1973 | Fed. Rep. of Germany . |
| 1329686 | 5/1963 | France . |
| 2224887 | 4/1973 | France . |

OTHER PUBLICATIONS

Michel et al.; Diffraction of a Plane Wave by a Finite Set of Cylindrical Conductors.

*Primary Examiner*—Eli Lieberman

*Attorney, Agent, or Firm*—Finnegan, Henderson, Farabow, Garrett & Dunner

[57] ABSTRACT

Process to attenuate or cancel certain side lobes of a microwave antenna pattern by using a network of parallel wires loaded with resistances that are adjustable at will, arranged as a filter in front of the antenna.

Application of this process to the elimination of the effects of active or passive interferences, as well as to the localization of jammers.

Adaptive filter for microwave antennas.

12 Claims, 5 Drawing Figures

ADAPTIVE SPATIAL MICROWAVE FILTER

BACKGROUND OF THE INVENTION

The invention at hand, in which Mr. Claude Chekroun, Mr. Yves Michel, and Mr. Henri Sadones have had a part, concerns a process for attenuating or canceling certain side lobes of a microwave antenna pattern, as well as the application of this process to the elimination of the effects of active or passive interferences (jammers, ground clutter, sea clutter, etc.) at the time of reception on the antenna, and also to the detection and localization of several jammers liable to blind the antenna at reception, and also the applications of this process to the partial and local attenuation at reception by an antenna.

It is possible to improve the level of side lobes of microwave antennas, by trying, on the one hand, for electronic scanning antennas, to multiply the number of radiating elements of the antenna and the possible values of phase shift; and, on the other hand, for all types of antennas, to use components having very tight mechanical and radioelectric tolerances.

It is, as a matter of fact, presently being studied how to attenuate or cancel certain side lobes of a microwave antenna pattern of the electronic scanning type to create "notches" (or "holes" or "zeros") at reception, in the direction of these lobes. To do this, either one modifies the phase and amplitude of each radiating element of the antenna in order to create the "notches" or one combines several elementary elements of the antenna that one switches in opposite phase with the energy received, in the direction of the side lobe in question.

These methods have fundamental disadvantages:

They require a very considerable number of drivers, and, therefore, involve a considerable cost and a long switching time and this, all the more as the size of the antenna is increased.

They require a long switching time, on the order of about ten to one hundred microseconds, to achieve the attenuation or cancellation of a secondary lobe in a given direction, which means that when one uses this process to eliminate the effect of a jammer the antenna is, during the switching time, blinded by the jammer and is, therefore, in danger of losing the target followed by the radar. In the case where one combines several radiating elements, this method monopolizes a zone of the antenna that, instead of taking part in the whole of the function serves only to create a "hole" at reception (if one wishes to create several "holes", the monopolized zones are more numerous, which implies a limitation of 2 or 3 "holes" at reception).

Recently another method as well, which is in the process of development, is being suggested which consists of associating with the principal directive antenna a secondary antenna which is considerably less directive and to subtract from the signals received by the principal antenna those received by the secondary antenna. The gain of the secondary antenna being noticeably constant for all directions of surveyed space, the energy received from a possible jammer would be of the same order of magnitude as that coming from the target in the secondary antenna, which is not the case for the principal antenna in which the gain in the direction of the jammer is weak. By a spatial correlation, it is possible, in this manner, to minimize the noise brought in at the level of the antenna by an active or passive jammer.

This method has many disadvantages: it is not completely adaptive; the signal received from the target is appreciably reduced from the moment of the first subtraction; this method cannot be used for more than two jammers. It is very costly because it requires an auxiliary antenna and its concommitant processing for each external interference.

This process, that is the object of this invention, completely avoids the disadvantages of the above-mentioned methods, that is:

It uses a considerably smaller number of drivers than the other methods, for an antenna of the same size.

It uses elements completely exterior to the antenna, and, therefore, no zone of the antenna is monopolized.

It does not require an auxiliary antenna. It is, therefore able to be used for several simultaneous jammers, without the antenna pattern being deformed in any appreciable way outside of the zones involved.

The speed of the process is such that a given secondary lobe can be attenuated or canceled by switching requiring a matter of time on the order of ten nanoseconds. One can immediately see the advantage of a process than can cause an attenuation or "hole" at reception by the antenna in any direction whatsoever even before the echo received from the target has returned to the antenna.

Moreover, to carry out this process, one uses, as one will see, an extremely simple technology and a very small number of drivers, which gives any resulting applications a great advantage in the areas of technological simplicity, simplicity of implementation and of drivers, as well as lower cost.

Finally this process may be applied to any antenna, be it mechanical scanning or electronic scanning.

SUMMARY OF THE INVENTION

The process of attenuation or cancellation of secondary lobes of the pattern is utilizable for any antenna that emits a linearly polarized wave. It consists of placing, as a filter in front of the antenna, a network of wires parallel to the electronic field vector of the plane microwave, loaded with resistances for which the values vary according to the intensity of the currents that will pass through them, which one can change at will in each wire.

BRIEF DESCRIPTION OF THE DRAWINGS

The accompanying drawings, which are incorporated and constitute a part of the specification, illustrate a preferred embodiment of the invention and, together with the general description of the invention given above and the detailed description of the preferred embodiment given below, serve to explain the principles of the invention.

Figure 1:
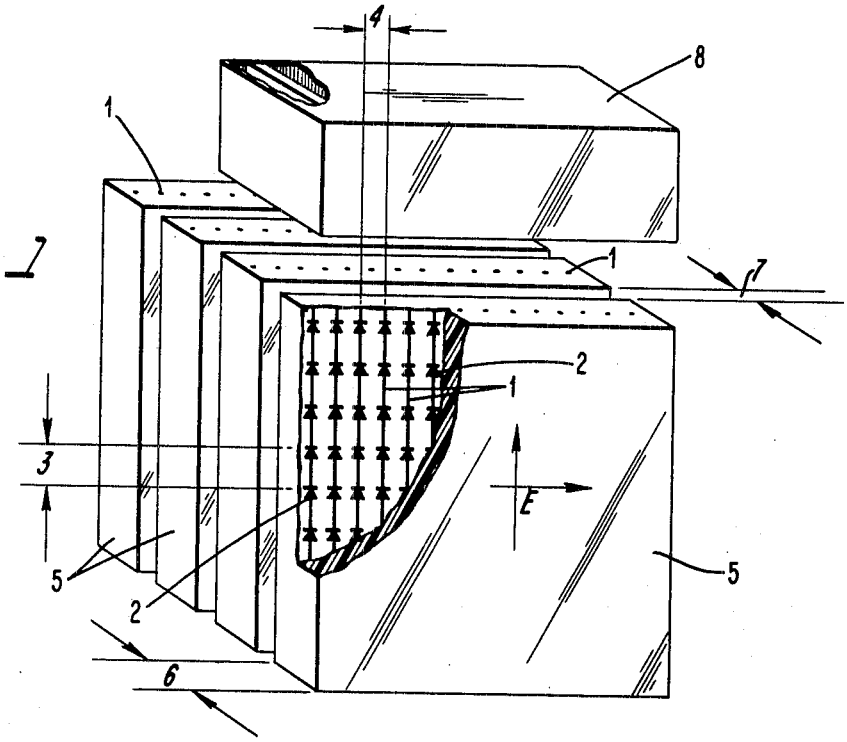
FIG. 1 is an illustration of four networks used in accordance with the teachings of the present invention.

One observes, as a result of the law of distribution of currents in the parallel wires of the network loaded with resistances, a spatial modulation of the amplitude of the wave passing through the network.

To bring about a suitable implementation of the process, the network is composed of parallel conducting wires. The wires are parallel to the electric field vector of the wave emitted by the antenna, and they contain diodes connected in series and placed with constant spacing along each of the wires.

Each diode-carrying wire is driven by an electric current so as to forward bias the diodes, by means of a switch that makes it possible to vary the intensities of this constant current in a wide range of values from a microamp to ten milliamps. When all the wires (and all the diodes) of the network of wires are driven by the same current, such a network causes an identical, total phase shift of the wave.

Moreover, the insertion losses of such a network are noticeably inversely proportional to the intensity of the constant current passing through the conductor wires. When one imposes a law of distribution of current intensities in the diode-carrying wires, one notices a spatial modulation of the amplitude of the wave, and, therefore, a modification of the pattern characteristic of the microwave antenna. The changes to the current intensities in the wires to produce a given spatial modulation of the amplitude of the wave are smaller as the spacing between diodes on each conductor wire is diminished and as the distance between conductor wires is made smaller. For example, the modulation of intensities is slight for a distance of less than one wave length of microwave energy in the case of PIN diodes.

The effect of such a modulation on the pattern in a given direction is the following for an antenna composed of $2SN=2N_z+1$ radiating elements the radiation pattern F ($\theta$) is:

$$F(\theta) = E(\theta) \sum_{n=-N_Z}^{N_Z} A_n e^{j(2\pi/\lambda)na(\sin\theta - \sin\theta_o)}$$

where

E ($\theta$) is the pattern of the elementary radiating element $A_n$ is the amplitude of the wave at the $n^{th}$ radiating element $\lambda$ is the wave length in free space a is the distance between radiating elements $\theta$ is the angle of observation $\theta_o$ is the pointing angle of the antenna in the presence of an amplitude modulation of the type:

$$\sum_{i=1}^{m} e_i \cos[(2\pi S_I/N)n + \phi_i]$$

where m is the number of directions affected by the attenuation $e_i$ is the amplitude of the modulation $S_I$ is the period for the modulation $\theta_i$ is the phase of the modulation For a direction $\theta_j$, if one chooses the period of modulation such that:

$$S_I/N = k - a/\lambda\ (\sin\theta_j - \sin\theta_o)$$

one will create a "hole" in the direction $\theta_j$ of the antenna pattern, if the following relations are met:

$$e_i = 2\frac{\sum_{n=-N_Z}^{N_Z} A_n e^{j(2\pi k - SI/N)n}}{\sum_{n=-N_Z}^{N_Z} A_n}$$

$$\phi_i = \pi - Ang\left[\sum_{n=-N_Z}^{N_Z} A_n e^{j(2\pi k - SI/N)n}\right]$$

where k is an integer.

Therefore, one can see that by modulating the intensity of the currents passing through the network of diode-carrying wires according to a given law of distribution, one will be able to create attenuations or cancellations of side lobe in the antenna pattern in all specified, desired directions other than those of the main lobe. One should also note that the insertion of such a network of diode-carrying wires, with constant, equal currents passing through them, on the order of several milliamps, in the path of the microwave emitted by the antenna, causes no problems for attenuation or phase shift of this emitted wave.

Indeed, it is always possible, as is already known, to match the network of diode-carrying wires in a frequency band on the order of 15% around the nominal frequency of the antenna, either by embedding this network of wires in a layer of dielectric material of a given thickness, or by placing between and parallel to these diode-carrying wires of the network, sectioned wires whose length gives those wires reactance which matches that of the networks for a given band of frequencies. The same effect is possible by using two networks of diode-carrying wires, separated from one another by a certain length called matching length.

During the emission of a microwave, the network is matched according to one of the methods indicated above, and the wires are all traversed by the same current, which is higher than a milliamp. What results is, at transmission, a very weak and evenly distributed attenuation over all the surface of the network, therefore not affecting the antenna pattern at emission. The uniform phase shift at transmission introduced on the incident microwave by such a network of diode-carrying wires traversed by identical currents on the order of a milliamp to several tens of milliamps is slight and on the order of a few degrees.

Because of the minimal influence at emission of the insertion of a network of diode-carrying wires, one will be able, of course, to modulate in a more efficient way without causing a change of phase in the transmitted wave, and to place in the path of the microwave not only a single network of diode wires, but two or several, provided that the wires of these networks are parallel to each other and parallel to the electric field vector of the microwave.

One must note that, in this case, the number of drivers to be used for the modulation will remain very small, given that the intensities in the corresponding wires of two or several networks will be able to be driven by a single circuit. If one places in the path of the microwave a network composed of two orthogonal grids of parallel, diode-carrying wires, each of which carries electric currents of the order of a milliamp that can be modulated by a switch, and if the electrical field vector of the incident microwave is inclined with respect to the axes of diode carrying wires, one could produce a spatial modulation. The angle between the electrical vector at the diode carrying wire will be preferably 45° for a better efficiency of modulations.

At one point on the crossed grid network, the two components, following the two directions of the grid wires of the incident electrical field, are subjected to the action of diode wires traversed by constant currents. At the exit of the crossed-grid network, the recombining of electronic field vector components which are in phase results in a linearly polarized vector whose direction is close to the initial direction, given the small values of the modulation amplitudes. If a cross-polarization vector appears, it is weak, and, in any case, can be eliminated by an adequate system of the cross-polarization absorption grid type. This process can be applied to stationary microwave antennas, to mechanically scanning antennas, to antennas scanning electronically in a plane perpendicular to the electric field vector of the microwave emitted, and to antennas scanning electronically in all directions, that is to say, in two perpendicular planes.

The process will apply especially well to electronically scanning antennas that have, by their construction, side lobes that are higher than those of conventional antennas.

Among the basic applications of the above process are the elimination of the effect of jamming on any microwave antenna emitting a linearly polarized wave. When a jammer disturbs the functioning of an antenna it is only necessary, as has been seen, to create a "hole" in the reception pattern of the antenna in the direction of the jammer to eliminate its effect.

If, in front of the antenna, one put a network of diode-carrying wires traversed by variable currents controlled by switches placed at the head of the wires, as is described in the process of the invention, one could, by traversing certain diode-carrying wires of this network with currents of different intensity, modify the amplitude of the wave and create a complete "hole" in the direction of the jammer by choosing the appropriate law of distribution of currents. An example of this choice is given further on, and depends on the type of diodes used and on the arrangement of diodes in the network.

In the case of several jammers disturbing the functioning of the antenna, one will create, because of the network of diode-carrying wires, notches in each of the directions of the extra jammers by choosing the correct law of current distribution.

Among the essential applications of the process are also the localizing of several jammers and this is done in less time than the time an echo takes to reach the antenna.

Indeed with a network of diode-carrying wires traversed by currents on the order of a few milliamps placed in front of a microwave antenna, it is possible, by modulating the amplitude, to successively create "holes" in all directions other than the pointing direction of the wave, and all this in the time period on the order of ten nanoseconds. It suffices to act on a very small number of drivers corresponding to each of the diode-carrying wires, completely independent of the antenna, and to modify the distribution of the currents corresponding to a simple modification of the current amplitude in the wires, which may be achieved in a very short time.

When a "hole" thusly created is located in the direction of the jammer, the energy sent by the jammer does not penetrate the antenna, the noise brought to the antenna is minimal. One can therefore, deduce the direction of the jammer. This is done in all successive directions, which allows, therefore, for detecting the directions of several jammers, from 5 to 10, even before the echo of the target comes back to he antenna. Therefore, the target is not lost and the direction of the jammer has been determined.

Of course, one can even follow a movable jammer by displacing the "hole" of the antenna pattern, by following the movement of the jammer without the special difficulties of switching.

Finally, another important application of the process is the reduction of the lobes of the reception pattern of an antenna radiating, at transmission, with a uniform illumination. One can, indeed, at emission, concentrate the energy on the target, since the uniform radiation of the antenna gives the maximum gain in the direction of the target, and decreases greatly the gain in directions other than that of the target, while causing a spatial distribution of the energy received due to a suitable law of distribution of intensities.

Given after this, as an example, is a description of the implementation of four networks of diode wires allowing the carrying out of the process according to the invention, referring to FIG. 1.

Thirty-one copper conductor wires (1) of 4/10 mm in diameter are placed parallel to one another. Each of these wires carries PIN diodes (2) (type HP 5082-3080) placed in series, uniformly distributed, the distance (3) between two diodes on the same wire being 21 mm. The wires are separated from one another by a spacing (4) of 56 mm. The assembly of these wires is placed in the center of a polyethylene plate (5) of which the radioelectric constant $\Sigma_R$ is equal to 2.35 and the tangent of loss is $4.10^{-4}$, the thickness (6) of this plate is 36 mm. One joins 4 networks imbedded in their dielectric plate, the plates being located at a distance (7) of 4 mm. A battery (8) of 31 switches is connected to $4\times31$ wires and allows polarization of each of the 31 lines with currents varying from 200 microamps to 20 milliamps in time spans less than 20 nanoseconds.

Figure 2:
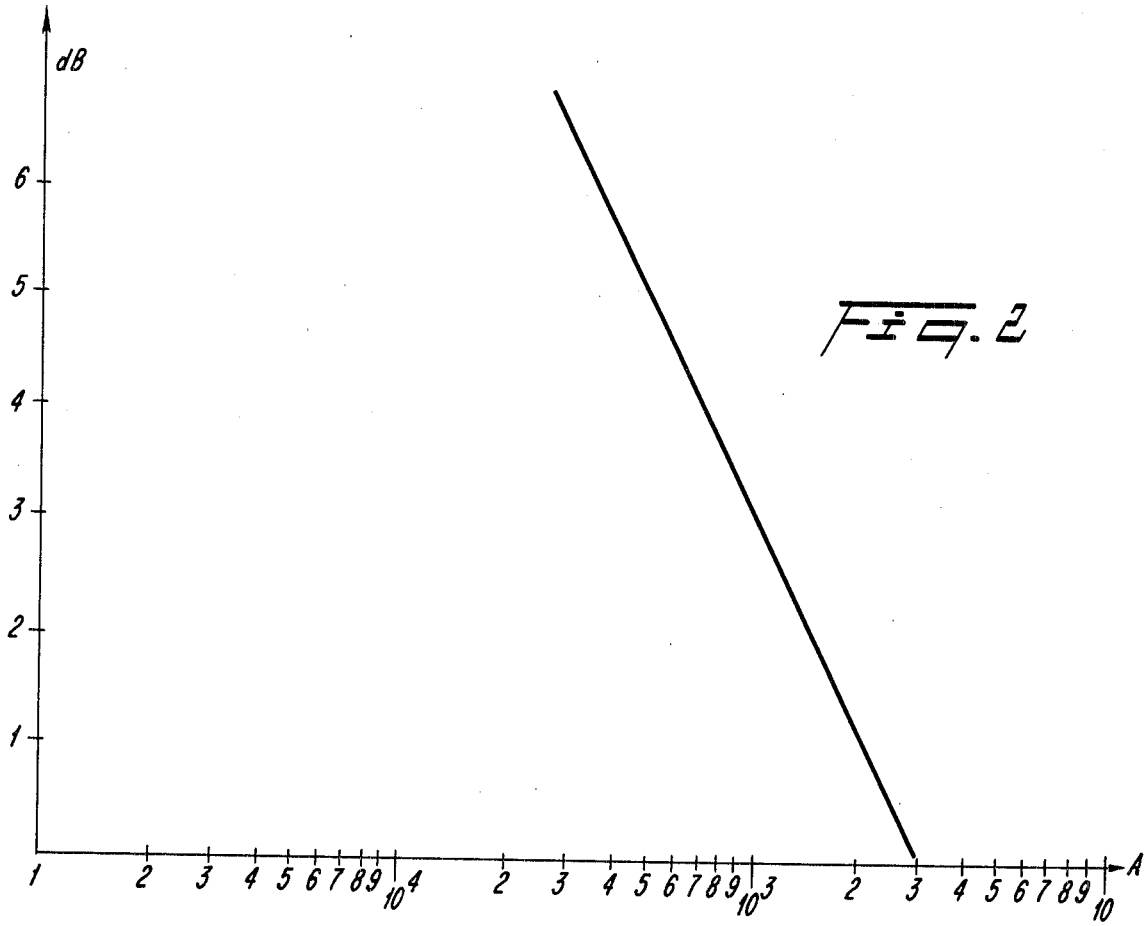
FIG. 2 illustrates the attenuation achieved by the networks of FIG. 1 when all the wires of the networks are uniformly polarized.

The assembly of these 4 networks placed in the path of a microwave, when all the wires are uniformly polarized, alternates the wave, depending on the intensity of the polarization current of the wires, according to FIG. 2. The abscissa is the intensity of polarization currents and the ordinate represents the insertion loss.

Figure 3:
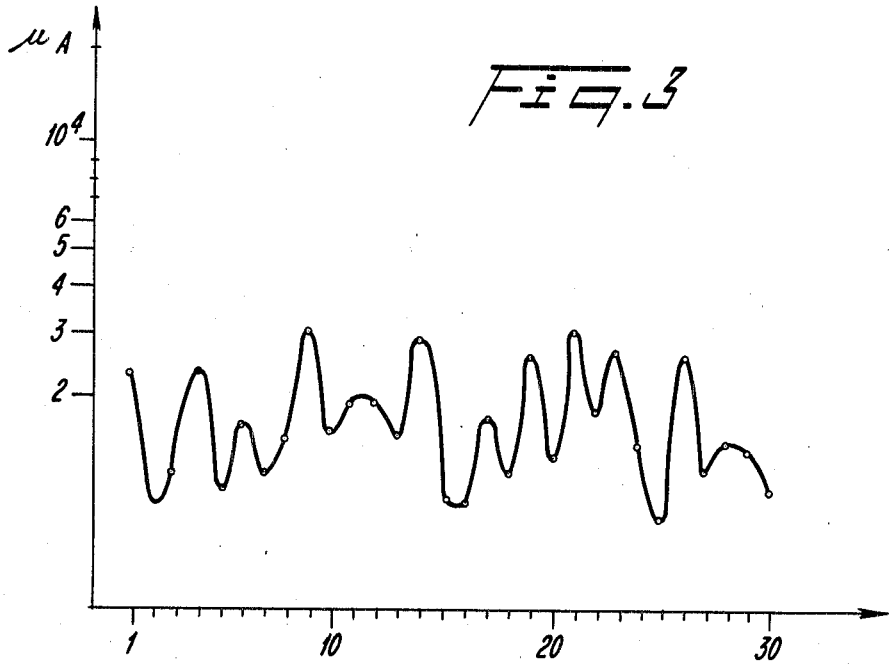
FIG. 3 illustrates an example of the distribution of current intensities in accordance with the teachings of the present invention.

An example of the distribution of current intensities in the diode wires is given in FIG. 3. The abscissa is the position of the wires and the ordinate is the intensity of the current. This distribution is anticipated for the application described later on the determination of 3 jammers in the case of an antenna of the type described hereafter.

This set of 4 networks is placed in front of an electronically scanned antenna, scanning the azimuth plane of which the characteristics are the following:

operating band: 2850–3050 megahertz
width: 1.75 m. in the plane of scanning
number of radiating elements: 31—electric field vector parallel to the wires
distance between radiating elements: 56 mm
phase increment: 22.5°
GAUSSIAN illumination with an attenuation of 15 dB on the edges of the antenna When a distribution of current intensities in the different diode wires of the 4 networks is imposed, as in FIG. 3, an amplitude modulation of the wave traversing the lens is, as in application of the general formula, of the type:

$$V(n)=1+0.14\cos(15.3\,n-2.85)+0.07\cos(-3.33\,n-0.80)+0.09\cos(-8.42\,n-0.48)$$

Figure 4:
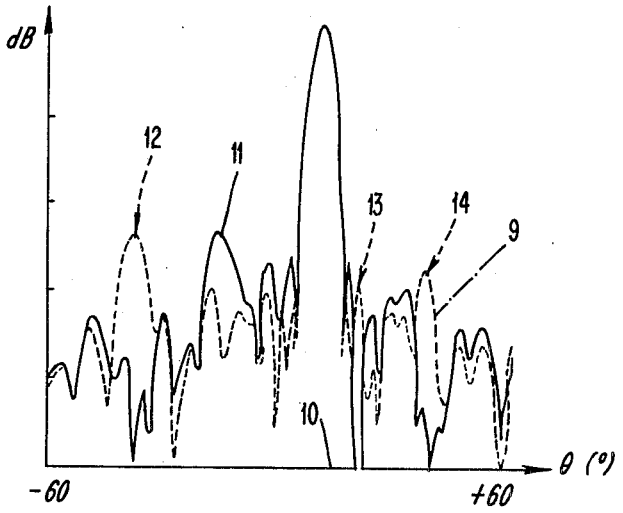
FIG. 4 illustrates antenna patterns using the teachings of the subject invention.

FIG. 4 shows by the dotted line (9) the antenna pattern pointing in a direction (10) in azimuth when all the wires are uniformly polarized with currents of 30 milliamps. On the solid line (11) is shown the modified pattern on which, after normalization to the initial pattern, one notices that three "notches" (12) (13) (14) have been created in three directions (−37°, 2°, 37°) corresponding to 3 active jammers illuminating the antenna in these directions.

No notable disturbance has been created in the other directions, the other lateral lobes remain less than 20 dB. Nevertheless, a loss of 1.6 dB is observed on the principal lobe, which does not show up here because of the normalization of the patterns. Given below, as an example, is the description of the implementation of another application of this invention to search for the direction of jammers.

Figure 5:
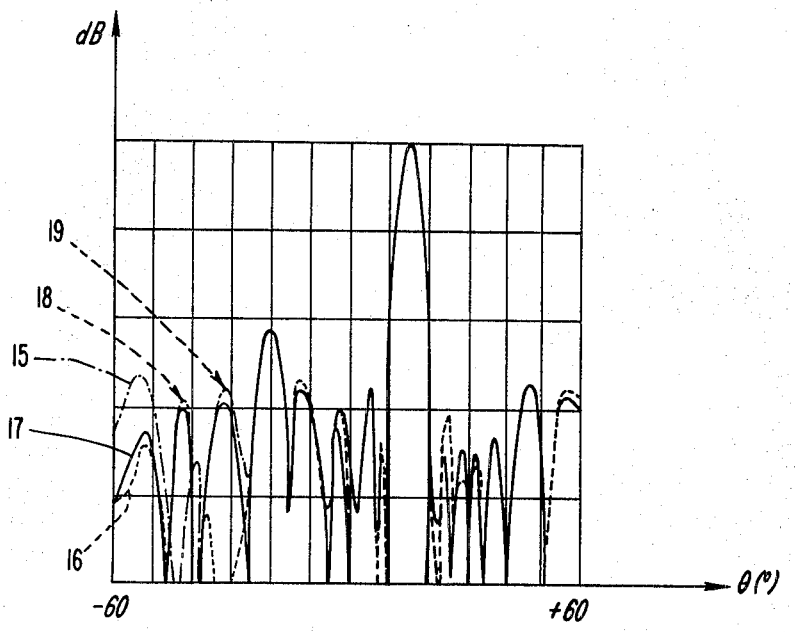
FIG. 5 illustrates additional antenna patterns using the teachings of the subject invention.

Starting with the previous elements, a network of diode-carrying wires traversed by currents that one can vary and an electronic scanning antenna, one changes as a whole the currents in the wires in such a way that the 3 parameters—amplitude, period, and phase—needed for modulation-meet the previously noted relations, so as to create a "notch" in the radiation pattern of the antenna. One displaces the "notch" by a simultaneous modification of three parameters. One will find in FIG. 5 two successive states (15) and (16) of the microwave pattern, the antenna pointing to 15° in azimuth, at two moments in time separated by 50 nanoseconds.

Pattern (17) corresponds to the pattern when the wires are uniformly polarized.

Pattern (15) includes a "notch" in the direction (18) of 54° and pattern (16) includes a "notch" in the direction (19) of 32°.

The search for one or several active jammers for a given pointing direction will be carried out in less than one microsecond.

We claim:

1. A process of adaptive coherent side lobe cancellation of a radiation pattern of a microwave antenna emitting linearly polarized microwaves without beam shifting said pattern comprising the steps of:

placing as a filter, in front of said antenna, a network of conductors, said conductors being loaded with variable resistances whose values vary according to the intensity of current in said conductors, and modulating the intensity of said currents in said conductors to vary the values of said resistances and thereby attenuate selected side lobes of said radiation pattern.

2. The process of claim 1 wherein said conductors are parallel conductive wires each positioned parallel to the electric field vector of said emitted microwaves;

wherein said variable resistances comprise diodes placed in series and distributed on each of said wires; and wherein said currents in said conductors are varied to forward bias said diodes according to a law of distribution of intensities.

3. The process of claim 2 wherein said diodes are distributed at even distances on each of said wires.

4. A process of adaptive coherent side lobe cancellation of a radiation pattern of a microwave antenna emitting linearly polarized microwaves without beam shifting said pattern comprising the steps of:

placing in front of said antenna, as a filter, a network of parallel conductive wires, each positioned parallel to the electric field of said microwaves, said conductive wires having diodes distributed at equal distances on each of said wires, the resistance of each of said diodes varying according to the intensity of current in said conductive wires; and modulating the intensity of said currents in said conductors to forward bias said diodes according to a law of distribution of intensity to vary the values of said diode resistances and thereby to attenuate selected lobes of said radiation pattern, said intensity of said currents being fed to said wires during a period of emission of microwaves from said antenna to forward bias said diodes by equal polarization currents, whereas during a period of reception of microwaves at said antenna, said intensity of said currents to said wires being selected to forward bias said diodes according to a law of distribution of intensity dependent upon the direction of said side lobes to be attenuated or cancelled.

5. The process of claim 4 further including the step of placing as an additional filter in front of said antenna one or more additional networks of conductors, the conductors of said additional networks being arranged parallel to each other and parallel to said electric field vector of said microwaves.

6. A process of adaptive coherent side lobe cancellation of a radiation pattern of a microwave antenna emitting linearly polarized microwaves, without beam shifting said pattern, for eliminating the effect of a jammer placed in a direction perpendicular to the electrical field vector of the said microwaves, comprising the steps of:

placing as a filter, in front of said antenna, a network of conductors, said conductors being loaded with resistances whose values vary according to the intensity of the currents in said conductors, and modulating the value of said resistances by selectively varying said currents to said conductors according to a law of distribution of intensity chosen to minimize the receptive effect by attenuating selected side lobes of said antenna in the direction of said jammer.

7. The process of claim 6 wherein said conductors are parallel conductive wires positioned parallel to the electric field vector of said microwaves; and wherein said resistances are composed of diodes placed in a series and distributed on each of said wires.

8. The process of claim 7 wherein said diodes are distributed at equal distances on each of said wires.

9. A process of adaptive coherent side lobe cancellation of a radiation pattern of a microwave antenna emitting linearly polarized microwaves, without beam shifting said pattern, for eliminating the effect of a jammer placed in a direction perpendicular to the electric field vector of said microwaves, comprising the steps of:

placing in front of said antenna, a filter, a network of parallel conductive wires positioned parallel to the electric field vector of said microwaves, said conductive wires containing diodes distributed at equal distances on each of said wires, the resistances of said diodes varying according to the intensity of the currents in said conductive wires, modulating said diode resistances by selectively varying said current to said conductive wires according to a law of distribution of intensity chosen to minimize the receptive effect of said antenna by attenuating selected side lobes in the direction of said jammer, the intensity of said currents being fed to said wires during a period of emission of microwaves from said antenna to forward bias said diodes by equal polarization currents, whereas during a period of reception of microwaves at said antenna, said intensity of said currents to said wires being selected to forward bias said diodes according to said law of distribution of intensity.

10. The process of claim 9 further including the step of placing as additional filters in front of said antenna one or more additional networks of conductors, the conductors of said additional networks being arranged parallel to each other and parallel to said electric field vector of said microwaves.

11. The process of claim 1, 2, 3, 4, or 5, wherein said step of modulating the intensity of said currents in said conductors to attenuate said selected side lobes results in said antenna receiving a minimum of noise.

12. The process of claim 1, 2, 3, 4, or 5 wherein the step of modulating the intensity of said currents in said conductors attenuates the side lobes of the reception pattern of an antenna radiating in emission with a uniform illumination, by using a gaussian distribution of intensities of currents of said conductors.

* * * * *